US005312541A

United States Patent [19]

Paulet et al.

[11] Patent Number: 5,312,541

[45] Date of Patent: May 17, 1994

[54] IMPROVEMENTS IN PROCESSES FOR COLORING ANODIZED ALUMINUM AND/OR ALUMINUM ALLOYS

[75] Inventors: Jean-Francois Paulet, Siblingen; Bruno Boetsch; Fritz Schneeberger, both of Schaffhausen; Günther Tscheulin, Frick; Hans Bohler, Rheinfelden, all of Switzerland

[73] Assignees: Sandoz Ltd., Basel; Schweizerische Aluminium AG, Chippis, both of Switzerland

[21] Appl. No.: 920,061

[22] Filed: Jul. 27, 1992

Related U.S. Application Data

[63] Continuation of Ser. No. 802,079, Dec. 3, 1991, abandoned, which is a continuation of Ser. No. 507,703, Apr. 10, 1990, abandoned, which is a continuation of Ser. No. 392,186, Aug. 10, 1989, abandoned, which is a continuation of Ser. No. 28,275, Mar. 20, 1987, abandoned.

[30] Foreign Application Priority Data

Mar. 25, 1986 [CH] Switzerland ..... 1223/86

[51] Int. Cl.[5] ..... C25D 3/32

[52] U.S. Cl. ..... 205/302; 205/300

[58] Field of Search ..... 204/54.1, 54.5, 37.6, 204/43; 205/302, 303, 304

[56] References Cited

U.S. PATENT DOCUMENTS

| | | | |
|---|---|---|---|
| 3,616,292 | 10/1971 | Wilson | 205/139 |
| 4,021,315 | 5/1977 | Yanagida et al. | 205/174 X |
| 4,244,791 | 1/1981 | Paulet et al. | 204/54.1 |
| 5,064,512 | 11/1991 | Brodalla et al. | 205/202 |

FOREIGN PATENT DOCUMENTS 1339133 11/1973 United Kingdom .

*Primary Examiner*—John Niebling
*Assistant Examiner*—John S. Starsiak, Jr.
*Attorney, Agent, or Firm*—Robert S. Honor; Richard E. Vila; Andrew N. Parfomak

[57] ABSTRACT

In acidic Sn(II)-containing electrolytes for coloring oxide layers on anodized aluminum or aluminum alloys, or for electroplating, the Sn(II)-ions are oxidized. By the addition of substances, so called stabilizers, to the electrolytes this oxidation can be more or less prevented i.e. Sn(II) can be more or less stabilized.

Furthermore, the effectiveness of the stabilizer can be decisive for the quality of the deposit or the coloring of the oxide layer. It is known that the presence of substantial amounts of Sn(IV) along with Sn(II), as a result of inadequate stabilization of the Sn(II), impairs the quality of the surface treatment.

An acidic, Sn(II)-containing electrolyte containing an addition of at least one soluble diphenylamine or substituted diphenylamine derivative stabilizes the Sn(II) and produces flawless coloring.

10 Claims, 1 Drawing Sheet

IMPROVEMENTS IN PROCESSES FOR COLORING ANODIZED ALUMINUM AND/OR ALUMINUM ALLOYS

Figure 1:
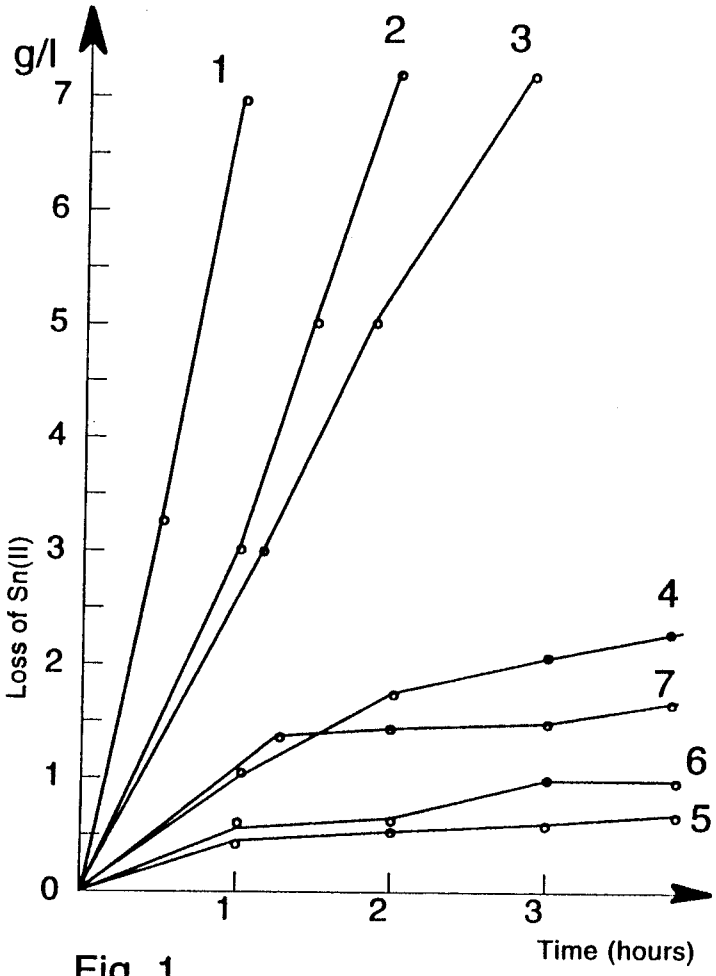

This is a continuation of application Ser. No. 07/802,079, filed Dec. 3, 1991, now abandoned which in turn is a continuation of application Ser. No. 07/507,703, filed Apr. 10, 1989 which in turn is a continuation of application Ser. No. 07/392,186, filed Aug. 10, 1989 which in turn is a continuation of application Ser. No. 07/028,275, filed Mar. 20, 1987, the latter three of which are now abandoned.

The preset invention relates to the stabilization of acidic Sn(II) containing electrolytes used for colouring oxide layers on anodized aluminum or aluminum alloys, or for electroplating.

Sn(II)-salts e.g. in the form of acidic sulphate, fluoroborate or chloride solutions are employed both for electroplating and for colouring anodic oxide layers on aluminum or aluminum alloys.

It is known that practically only the acidic sulphate bath contains simple Sn(II)-ions. In all other electrolytes the tin is at least partly bonded in the form of complexes.

One difficulty encountered in electroplating or in colouring anodic coatings on aluminum or its alloys in acidic solutions is that the Sn(II)-ions are oxidized to Sn(IV)-ions during the process. By adding substances to the electrolyte, so called stabilizers, the oxidation can be more or less prevented, i.e. the Sn(II)-ions can be more or less stabilized.

The effectiveness of the stabilizer is decisive for the quality of the deposit or the colouring of the anodic oxide layer. It is generally well known that the quality of the surface treatment diminishes in the presence of large quantities of both types of ion, Sn(II) and Sn(IV) due to inadequate stabilizing of the Sn(II). One should therefore endeavour to maintain the tin in the acidic solution as Sn(II)-ions.

Also known as stabilizers for acidic electrolytes are aromatic compounds containing amino groups e.g. aminophenol, dimethylaniline.

These compounds have a stabilizing effect on Sn(II)-ions; they cannot, however, prevent a fraction of the Sn(II)-ions being oxidized to Sn(IV). Consequently the quality in particular of the colouring of the anodic coatings on aluminum and aluminum alloys is affected. If the Sn(II)-ions are not adequatly stabilized, the depth of colour in the dark colour ions and the uniformity of the colour are often unsatisfactory. This is a significant disadvantage of the stabilizers used up to now. An ideal stabilizer would be one that achieves complete stabilization of the Sn(II)-ions. In fact it is, however, difficult on colouring anodic coatings on aluminum and its alloys to produce colours such as dark bronze or black using the above mentioned additives. Mostly the scattering behaviour of the electrolyte is also unsatisfactory, with the result that lighter and darker colouring of the edge regions occurs. As the period of colouring progresses—after about 10 minutes—excessive colouring occurs and one obtains a metallic deposit on the surface. This leads to problems in cleaning the coloured surface; contamination of the sealing baths and corrosion problems follow.

It has been found now that diphenylamine and substituted diphenylamine derivatives substantially stabilizes Sn(II)-ions in an acidic solution. These compounds also improve the scattering properties of the tin(II)-electrolyte and consequently the distribution of the current.

Accordingly, there is provided a stabilizing composition for Sn(II)-ions containing, as active ingredient, diphenylamine or a substituted diphenylamine derivative or a mixture thereof, said ingredient being soluble in an acidic medium.

Advantageously, the diphenylamines of the invention are soluble in water at 20° C. in an amount of at least 5 mg/l at a pH<5.

Particularly suitable diphenylamines according to the invention are the compounds of formula I

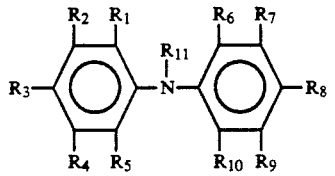

I in which each substituent $R_1$ to $R_{10}$, independently, is selected from the group consisting of hydrogen; halogen (at most one for each ring); nitro (at most one for each ring); —COOM (at most two for each ring); —$SO_3M$ (at most, two for each ring); —$NH_2$ (at most two for each ring); $C_{1-4}$alkyl; and phenylamino (at most one for each ring), $R_{11}$ is hydrogen; $C_{1-4}$alkyl; β- to ω-hydroxy-$C_{1-4}$alkyl; phenyl; or $\text{-}(\text{B—O})_n\text{-}R_{12}$ where each B, independently, is —$C_2H_4$—, —$C_3H_6$— or —$C_4H_8$—, n is a number from 1 to 20 inclusive and $R_{12}$ is H, —$SO_3M$ or —$CH_{22}COOM$, and M is hydrogen or the equivalent of a cation, or a mixture of such compounds.

Halogen can be fluoro, chloro or bromo, preferably chloro. When M is the equivalent of a cation, it is preferably an alkali metal, an equivalent of an alkali earth metal or a substituted ammonium. Preferably M is hydrogen.

In the $\text{-}(\text{B—O})_n\text{-}R_{12}$ residue, each B is preferably selected from —$C_2H_4$— and $$-\underset{\underset{CH_3}{|}}{CH}-CH_2-.$$

More preferably each B is —$C_2H_4$—.

n is preferably a number from 1 to 5 inclusive.

$R_{12}$ is preferably —$SO_3M$.

Preferably each ring, independently, bears 1, 2 or 3 $C_{1-4}$alkyl groups.

Preferred compounds of formula I are those substituted on the phenyl rings ($R_1$ to $R_{10}$) by a total of one or two amino groups, a total of one or two —COOM, or a total of one or two —$SO_3M$, or a combination of the indicated amino with the —COOM or —$SO_3M$ groups.

Of the described group of compounds according to the invention the following substances have been found to be particularly advantageous additives:

2-amino-diphenylamine
4-amino-diphenylamine
4-amino-diphenylamine-2-carboxylic acid
diphenylamine-4-sulfonic acid
2-amino-diphenylamine-4-sulfonic acid
4-amino-diphenylamine-2-sulfonic acid
4,4'-diamino-diphenylamine-2-sulfonic acid 4'-amino-4-nitrodiphenylamine-2-sulfonic acid 1-amino-2,4-di(phenylamino)benzene-5-sulfonic acid, and diphenylamine -4,4'-disulfonic acid, and their mixtures, as well as diphenylamine.

Preferred mixtures are those based on diphenylamine-monosulfonic acid with diphenylamine-disulfonic acids.

The compounds of formula I can be prepared according to known methods.

The stabilizing composition is preferably an aqueous solution which may contain, as further assistants, an organic or inorganic acid for the adjustment of the pH-value, preferably sulphuric or chlorhydric acid, a further solubilising agent and/or a sequestering agent. The stabilizing composition has preferably a pH<5. The concentration of the stabilizing agent may vary up to 95% by weight.

According to a preferred embodiment, the composition of the invention may contain, in addition to the stabilizing agent and the optional assistants as mentioned, a tin(II)-electrolyte.

Suitable tin(II)-electrolytes are tin(II)-salts as used for the surface treatment, particularly the colouring of oxide layers on aluminum or aluminum alloys produced by anodizing or for electroplating purposes. Preferred tin(II)-electrolytes can be for example acidic tin(II) sulphate, fluoroborate or chloride; tin(II)sulphate is particularly preferred.

The concentration of the tin(II)-electrolyte and the stabilizing agent may vary within a large range; concentrated compositions may be diluted. The stabilizing agent is advantageously present in a concentration as required for the effective stabilization of the tin(II)ions present in the composition. The stabilizing agent may also be present in an excess.

The composition of the invention comprising a stabilizing agent and a Sn(II)-electrolyte has advantageously an acidic pH. Preferably the pH is from 1 to 5; more preferably as low as 1. When the Sn(II)-electrolyte is tin sulphate, the pH of the composition is preferably adjusted with sulphuric acid.

The present invention also provides a process for stabilizing an acidic tin(II)-electrolyte comprising contacting the electrolyte with an effective amount of diphenylamine or a substituted diphenylamine derivative or a mixture thereof to prevent the oxidation of the Sn(II)ions.

Acidic tin(II)-electrolyte baths stabilized with a diphenylamine as disclosed above, particularly a bath as used for electroplating or colouring oxide layers on anodized aluminum or aluminum alloys, form also part of the invention.

Furthermore, the invention also provides a process for colouring oxide layers on anodized aluminum or aluminum alloys or for electroplating with a Sn(II) containing electrolyte, in which the Sn(II) electrolyte is stabilized by diphenylamine or a substituted diphenylamine derivative or a mixture thereof.

The colouring of oxide layers on anodized aluminum or aluminum alloys or the electroplating, particularly of a metal surface, with a tin(II)-electrolyte stabilized according to the invention, can be effected in accordance with known methods, e.g. as disclosed in U.S. Pat. No. 3,849,263. After the electrolytic colouring, the resulting aluminum or metal surface may be sealed or at first be dyed with an organic dyestuff and then sealed according to known methods.

Preferably the stabilizing agent of the invention is used in the tin(II)-electrolyte treatment bath in an amount of from 20 mg/l to 1 g/l, more preferably 20 mg/l to 500 mg/l, particularly 100 mg/l to 200 mg/l.

The stabilizing agent may be added separately or as a combination with the Sn(II)-electrolyte to the treatment bath.

Preferably, in the composition of the invention as well as in the treatment bath, the weight ratio of Sn(II)-electrolyte to the stabilizing agent is 2–30:0.02–1.

It has surprisingly been found that by adding to the electrolyte baths, compounds of the group according to the invention the problems of overcolouring in the advanced stages of the colouring process no longer occur in the colouring of aluminum oxide layers obtained by anodizing. The problem of the often disadvantageous occurrence of the dark colour tones and the non-uniformity of the colour, which always recurred on colouring oxide coatings in the presence of the conventional stabilizers mentioned at the start, is substantially alleviated or completely eliminated by using the stabilizing agent according to the invention. The excellent colouring properties apply not only to the light colour tones, but in particular also to the dark colour tones which up to now were very difficult to achieve both with respect to the depth of colour tone and the uniformity of colour.

Particularly surprising is that these compounds are highly effective even in very small concentrations. Already at a concentration of 20 ppm a substantial stabilizing effect is achieved.

In all it was found that the disadvantages mentioned at the start concerning the known stabilisizers for acidic Sn(II) containing electrolytes for colouring aluminum oxide layers obtained by anodizing or for electroplating purposes did not occur with the electrolytes according to the invention, or else only to a degree that did not disturb and was therefore negligable.

In order that the advantages of the electrolyte stabilized according to the invention over the electrolytes used up to now are fully recognized, all factors viz., stabilizing of the Sn(II)-ions, scattering characteristic/-current distribution, colouring effect, must of course be judged together.

The following two test series and colouring trials were carried out to demonstrate the excellent effect of the stabilization and the resultant better colouring properties obtained with anodized aluminum and aluminum alloys in acidic solutions. The purpose of the test series is to show, by means of a quick test involving treatment with pure oxygen, the stabilizing effect of the additives according to the invention.

TEST SERIES 1

An aqueous electrolyte was prepared containing 10 g/l of $H_2SO_4$ and 20 g/l of $SnSO_4$. Under these conditions the tin is initially present as Sn(II). The electrolyte was divided into 7 containers all having the same geometric form. Each container contained 1 litre of electrolyte.

Bath No. 1: no stabilizer

The other baths contained the following stabilizer additions:

Bath No. 2: Paraphenolic sulfonic acid, 20 g/l (the addition normally used up to now).

Bath No. 3: N,N-dimethylaniline, 100 mg/l (known additive)

Bath No. 4: diphenylamine, 100 mg/l

Bath No. 5: diphenylamine-4-sulfonic acid, 100 mg/l
Bath No. 6: 2-amino-diphenylamine-4-sulfonic acid, 100 mg/l
Bath No. 7: 4-amino-diphenylamine-2-carboxylic acid, 100 mg/l In all baths the pH had a value of 1; the baths were all at room temperature and were stirred continuously by a magnetic stirrer. Each bath had pure oxygen, 200 $cm^3$ per minute, bubbled through it via glass chips, and was analyzed every half hour for Sn(II)-ion content. The results are presented in FIG. 1.

TEST SERIES 2

The same basic solution as in test series 1 was prepared and likewise 1 litre of electrolyte filled into each of the same container as used in that test series. In all of the baths the pH had a value of 1; the baths were at room temperature and were stirred continuously by a magnetic stirrer.

Bath 8 corresponded to bath No. 1 in the first test series and contained no additives. The following three baths all contained diphenylamine-4-sulfonic acid viz., Bath No. 9: 20 mg/l
Bath No. 10: 100 mg/l
Bath No. 11: 200 mg/l Bath No. 10 therefore corresponded to bath No. 5 in the first test series.

As in the first test series each bath had pure oxygen bubbled through it via glass chips at a rate of 200 $cm^3$/minute; again the Sn(II) content wa determined every half hour. The results are presented in FIG. 2.

Figure 2:
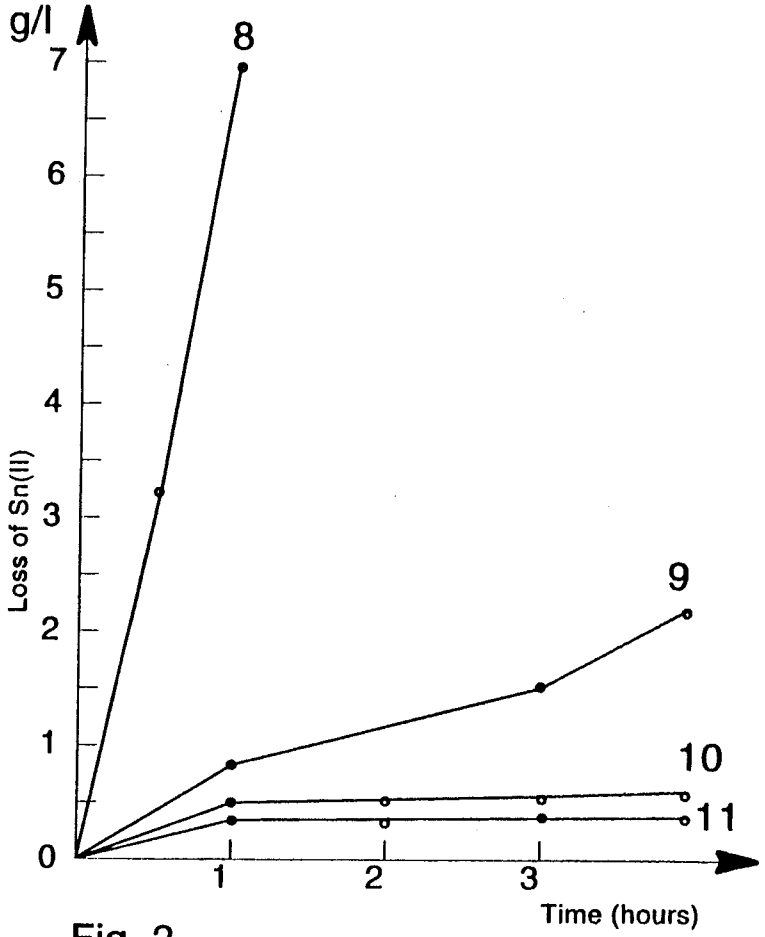

What can be seen from both FIGS. 1 and 2 is that, when no addition had been made, a large fraction of the Sn(II)-ions had been converted to Sn(IV)-ions within a relatively short time. Furthermore, it can be seen that the stabilizing effect is dependent both on the substance added and on the amount added. In spite of the much larger amount added the known additives, paraphenolic-sulfonic acid and N,N-dimethylaniline, were much less effective stabilizers for Sn(II)-ions than the additives according to the invention.

The following Example illustrates the invention without limiting the scope.

EXAMPLE

Half-hard PERALUMAN-100 panels having each a dimension of 200×300×1.5 mm were anodized using the normal direct current/$H_2SO_4$ process. The thickness of the oxide layer was 20 μm. These panels were introduced in 60 litres of a bath containing 10 g/l $H_2SO_4$, 20 g/l $SnSO_4$ and 200 mg/l diphenylamine-4-sulfonic acid and were treated for 8 minutes with a voltage of 15 V.

The procedure was repeated using a treatment bath based on the compositions 1 to 11 as disclosed above in test series 1 and 2, and at a treatment time varying from 1 to 12 minutes.

In all cases where a stabilizing agent of the invention was used a completely uniform bronze colour was obtained, free of edge discolouration. With the additions normally used up to now one frequently encounters edge effects in the bronze colour tones; this is due to the poor scattering characteristic of the electrolyte. This means that the Sn(II)-containing electrolytes with the new stabilizers have better scattering behaviour than the electrolytes used up to now for that purpose. The result is a better current distribution and thus a related more uniform colouring of the anodic oxide layer.

What is claimed is:

1. A process for coloring oxide layers on anodized aluminum or aluminum alloys comprising treating the anodized aluminum or aluminum alloy with a water soluble acidic composition comprising a Sn(II) electrolyte and a stabilizing agent selected from the group consisting of:

4-amino-diphenylamine-2-carboxylic acid
diphenylamine-4-sulfonic acid,
2-amino-diphenylamine-4-sulfonic acid
4-amino-diphenylamine-2-sulfonic acid
4,4'-diamino-diphenylamine-2-sulfonic acid
4'-amino-4-nitrodiphenylamine-2-sulfonic acid
1-amino-2,4-di(phenylamino)benzene-5-sulfonic acid, and
diphenylamine -4,4'-disulfonic acid, and mixtures thereof.

2. A process according to claim 1 wherein the weight ratio of Sn(II)-electrolyte to the stabilizing agent is 2:30 to 0.02:1.

3. A process according to claim 1 wherein the stabilizing agent is present in an amount of from 20 mg/l to 1 g/l of Sn(II)-electrolyte treatment bath.

4. A process for coloring oxide layers on anodized aluminum or aluminum alloys comprising treating the anodized aluminum or aluminum alloy with a water soluble acidic composition a Sn(II) electrolyte and a stabilizing agent according to Formula I:

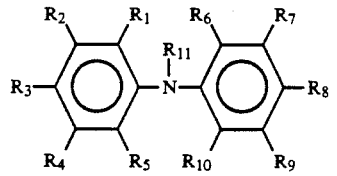

(I)

wherein each substituent $R_1$ to $R_{10}$ which are not hydrogen are selected from one of the groups consisting of:

a) one or two —COOM;
b) one or two —$SO_3M$;
c) one or two —$NH_2$ and one or two —COOM, and
d) one or two —$NH_2$ and one or two —$SO_3M$ wherein $R_{11}$ is hydrogen, $C_{1-4}$alkyl, β to ω-hydroxy-$C_{1-4}$alkyl, phenyl or $(B—O)_nR_{12}$, wherein each B, independently is —$C_2H_4$—, —$C_3H_6$— or $C_4H_8$—,
n is from 1-20 inclusive;
$R_{12}$ is H, —$SO_3M$ or —$CH_2COOM$; and,
M is hydrogen or the equivalent of a cation;
or a mixture of said compounds.

5. A process according to claim 4 in which the stabilizing agent comprises diphenylamine-4-sulfonic acid.

6. A process according to claim 4 in which the stabilizing agent is a mixture of diphenylamine-monosulfonic acid and diphenylamine-disulfonic acid.

7. A stabilized electrolytic composition comprising a) Sn(II) electrolytes; and
b) a stabilizing agent which is one or more compounds of the formula:

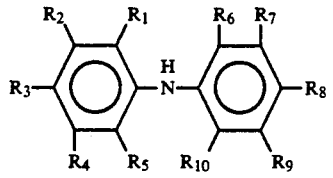

wherein the $R_1$ to $R_{10}$ which are not hydrogen are selected from one of the groups consisting of:

a) one or two —COOM;

b) one or two —$SO_3M$;

c) one or two —$NH_2$ and one or two —COOM; and d) one or two —$NH_2$ and one or two —$SO_3M$, wherein M is hydrogen or the equivalent of a cation, in an aqueous solution.

8. The composition of claim 7 in which the stabilizing agent comprises diphenylamine-4-sulfonic acid.

9. The composition of claim 7 in which the stabilizing agent is a mixture of diphenylamine-monosulfonic acid and diphenylamine-disulfonic acid.

10. A stabilizing electrolytic composition comprising:

a) Sn(II) electrolytes; and b) a stabilizing agent selected from the group consisting of:

4-amino-diphenylamine-2-carboxylic acid,
diphenylamine-4-sulfonic acid,
2-amino-diphenylamine-4-sulfonic acid,
4-amino-diphenylamine-2-sulfonic acid,
4,4'-diamino-diphenylamine-2-sulfonic acid,
4'-amino-4-nitrodiphenylamine-2-sulfonic acid,
1-amino-2,4-di(phenylamino)benzene-5-sulfonic acid, and mixtures thereof;

in an aqueous solution.

* * * * *